US005125538A

United States Patent [19]

Morris, Sr.

[11] Patent Number: 5,125,538

[45] Date of Patent: Jun. 30, 1992

[54] CHILD-RESISTANT MOLDED LIQUID CONTAINER LID ASSEMBLY FOR OPEN HEAD CONTAINERS

[76] Inventor: Glenn H. Morris, Sr., 1192 Cumberland Rd., Chattanooga, Tenn. 37419

[21] Appl. No.: 605,456

[22] Filed: Oct. 30, 1990

[51] Int. Cl.[5] ..... B67D 5/60

[52] U.S. Cl. ..... 222/143; 222/153; 222/545; 220/288; 215/329

[58] Field of Search ..... 222/143, 545, 552, 562, 222/575, 153; 220/255, 288, 323; 215/329; 206/521

[56] References Cited

U.S. PATENT DOCUMENTS 2,234,168 3/1941 Hothersall ..... 222/545 X
3,048,308 8/1962 Kleid ..... 222/545 X
3,281,006 10/1966 Wei ..... 22/143 X
4,732,288 3/1988 Morris, Sr. ..... 220/323 X
4,967,926 11/1990 Morris, Sr. ..... 220/323

*Primary Examiner*—Michael S. Huppert
*Assistant Examiner*—Gregory L. Huson
*Attorney, Agent, or Firm*—Brady, O'Boyle & Gates

[57] ABSTRACT

A child-resistant molded container lid assembly for an open head container, wherein a closure having a pouring spout is fixedly secured to the top edge of the container. A lid having an integral cap portion is threadably connected to the container and the spout portion, wherein the cap portion closes the pouring spout. The cap portion of the lid is provided with a shock absorber to prevent damage to the cap portion and associated pouring spout during the transportation and/or stacking of the filled container.

20 Claims, 5 Drawing Sheets

FIG. 2
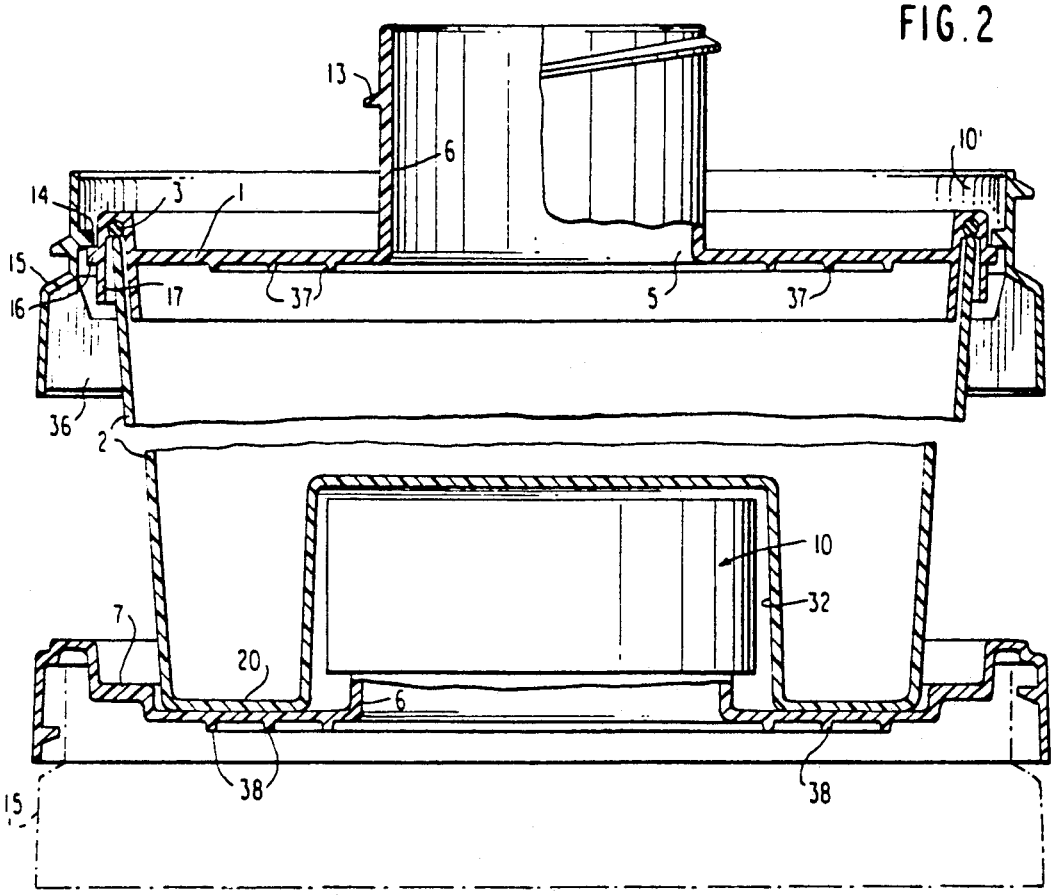
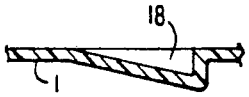
FIG. 4
FIG. 3
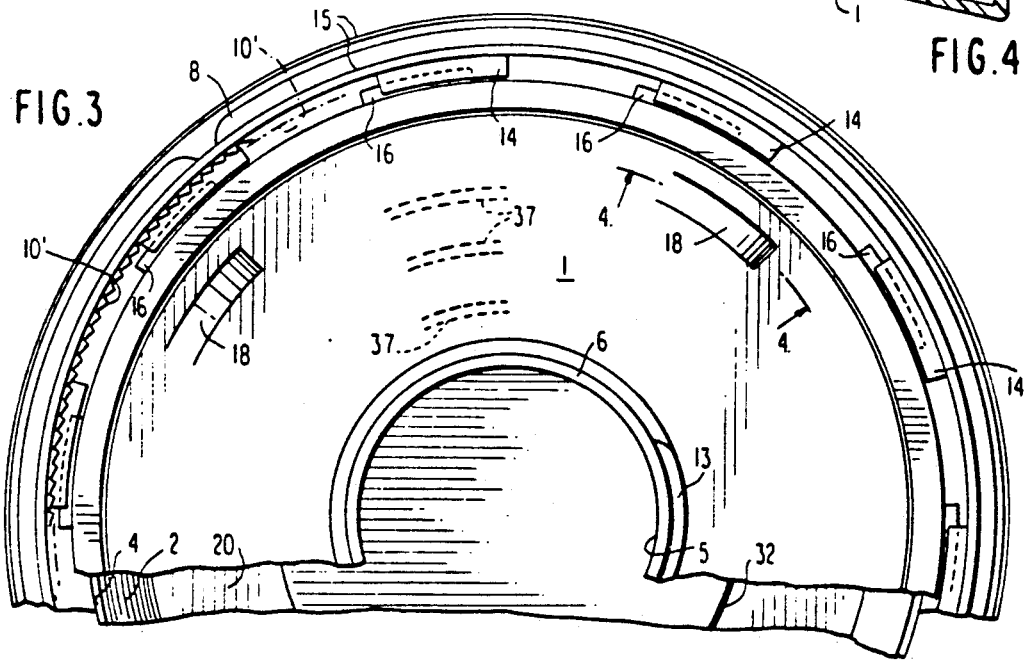

FIG.7
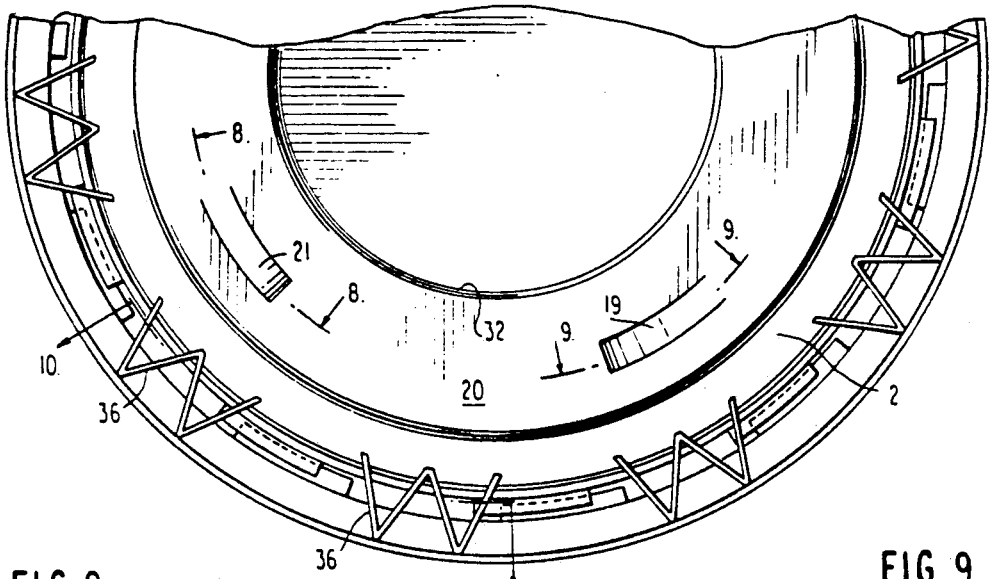
FIG.8
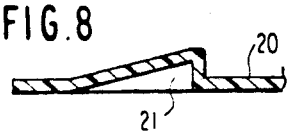
FIG.9
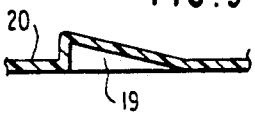
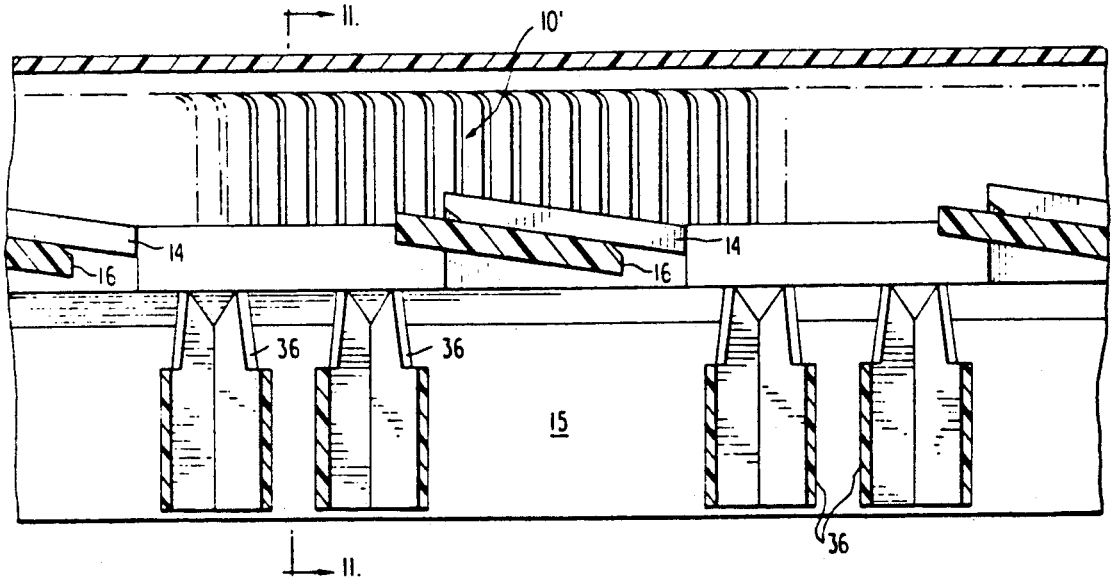
FIG.10

FIG. 11
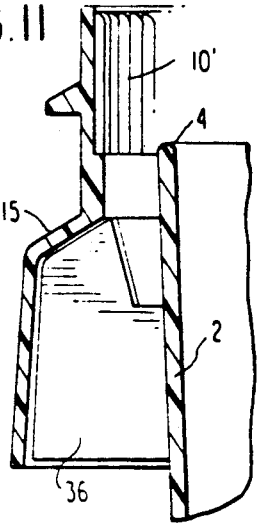
FIG. 12
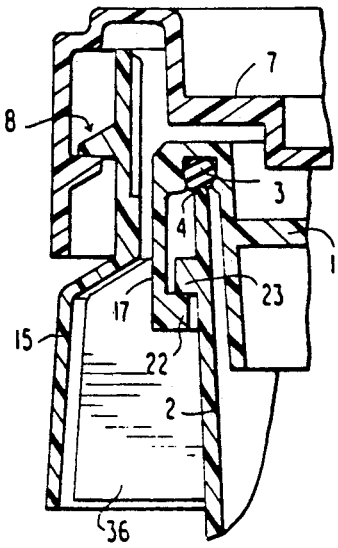
FIG. 13
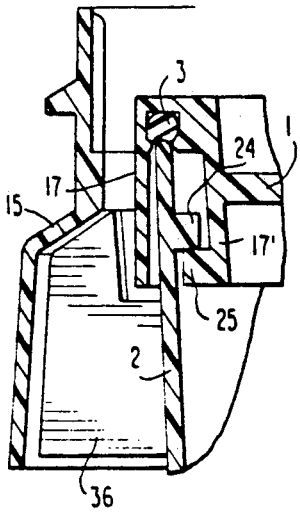
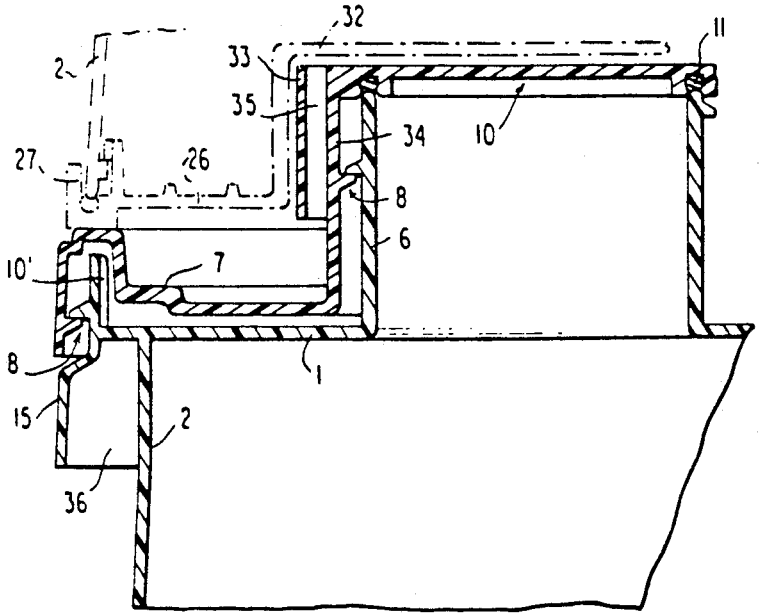
FIG. 14
FIG. 15
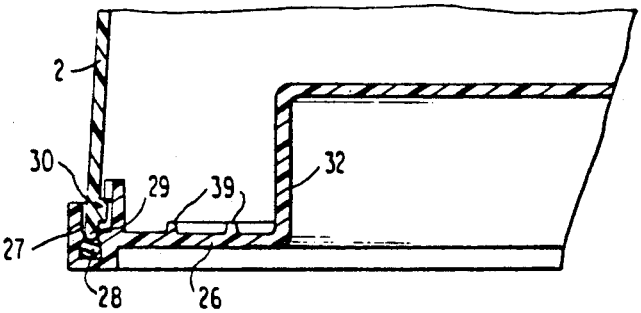
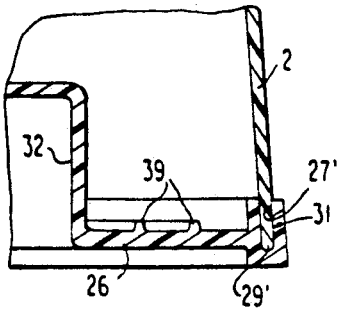

CHILD-RESISTANT MOLDED LIQUID CONTAINER LID ASSEMBLY FOR OPEN HEAD CONTAINERS

BACKGROUND OF THE INVENTION

The child-resistant molded liquid container lid assembly for open head containers of the present invention is of the type disclosed in my U.S. Pat. 4,732,288, dated Mar. 22, 1988, and pending application Ser. No. 07/363,764, filed Jun. 9, 1989, now U.S. Pat. No. 4,967,926, issued Nov. 6, 1990, wherein a threaded connection is provided between the container and lid, and the lid is provided with a resiliently biased locking member pivotally connected to the lid and cooperating with locking teeth on the container. While these lids have been satisfactory for sealing bulk material, such as powders, grain, etc. packaged within the container, they have not been entirely satisfactory for sealing the containers when liquid is contained therein. It has been found that the sealing ring, carried by the lid which engages the top edge of the container when the lid is in place on the container, does not always provide an effective seal to prevent leakage from the container around the top edge of the container. This is due mainly because the lid is not sufficiently tightened on the container to squeeze the sealing ring in tight engagement with the top edge of the container.

SUMMARY OF THE INVENTION

In the continuing research and development to improve my child-resistant molded plastic container lids for use on open head containers to prevent leakage of various liquids, as well as solid material, the container lid assembly of the present invention has been devised which comprises essentially, a closure fixedly mounted on an open head container, the closure including a peripheral sealing ring engaging the top edge of the container. A central opening is formed in the closure to provide a pouring spout to facilitate dispensing liquid from the container. A lid is removably connected to the container closure for closing the pouring spout and includes a circumferentially threaded connection between the container and the lid and a resiliently biased locking member pivotally connected to the lid and cooperating with locking teeth on the container. The central portion of the lid is provided with an integral cap portion for closing the open end of the spout, and a sealing ring is carried by the cap portion and engages the top edge of the spout. By this construction and arrangement, when the lid is threaded onto the container, the cap portion and associated seal are pressed against the top edge of the pouring spout to effectively seal the liquid within the container.

The force employed to screw the lid onto the container is applied at a point radially outwardly from the cap portion of the lid, that is on the circumference of the lid, resulting in an increased torque for applying the integral cap portion and compressing its associated seal to the closure spout than would have been achieved if the cap portion was a separate component merely threaded onto the spout.

In one embodiment, the closure is secured to the open end of the container by a bayonet-type connection, and in another embodiment, the closure is molded integral with the top of the container, while a separate bottom wall is connected to the open end at the bottom of the container.

The cap portion of the lid is provided with a shock absorber to prevent damage to the cap portion and associated pouring spout during the transportation and/or stacking of the filled containers.

BRIEF DESCRIPTION OF THE DRAWINGS

FIG. 2 is a vertical, fore-shortened, fragmentary, sectional view showing a pair of stacked containers having a lid on the lower container, but the lid removed from the upper container;

FIG. 3 is a fragmentary, top plan view of the closure portion of the upper container shown in FIG. 2;

FIG. 4 is a view taken along line 4—4 of FIG. 3;

FIG. 7 is a bottom plan view of the container showing the lower surface of the bayonet connection for securing the lid to the top of the container;

FIG. 8 is a vertical, sectional view through the bottom of the container taken along line 8—8 of FIG. 7;

FIG. 9 is a vertical, sectional view through the bottom of the container taken along line 9—9 of FIG. 7;

FIG. 10 is a fragmentary, vertical, sectional view taken along lines 10—10 of FIGS. 6 and 7;

FIG. 11 is a fragmentary, vertical sectional view of the top edge of the container taken along line 11—11 of FIG. 10;

FIG. 12 is a fragmentary, vertical sectional view similar to FIG. 6 showing a modified form of the connection of the closure to the top of the container;

FIG. 13 is a fragmentary, vertical sectional view showing a further modified form of the connection of the closure to the top of the container;

FIG. 14 is a fragmentary, fore-shortened, vertical sectional view showing a modified form of the invention, wherein the closure is integral with the top of the container, and the bottom of the container is locked onto the container body; and FIG. 15 is a fragmentary, vertical sectional view of a modified form of the connection between the container bottom and container body shown in FIG. 14.

DESCRIPTION OF THE PREFERRED EMBODIMENT

Figure 1:
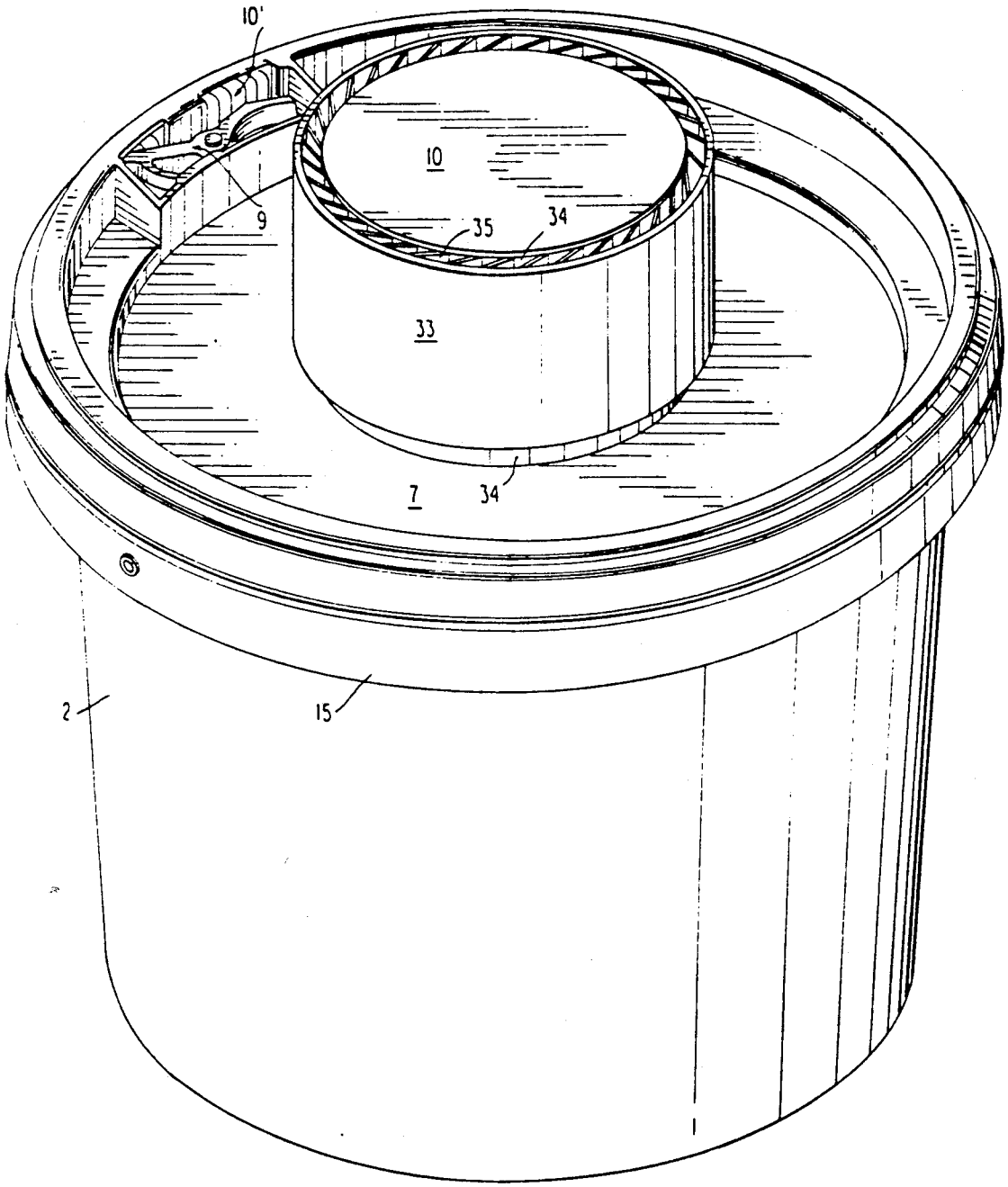
FIG. 1 is a prospective view of an open head container and the child-resistant lid of the present invention mounted thereon.
Figure 6:
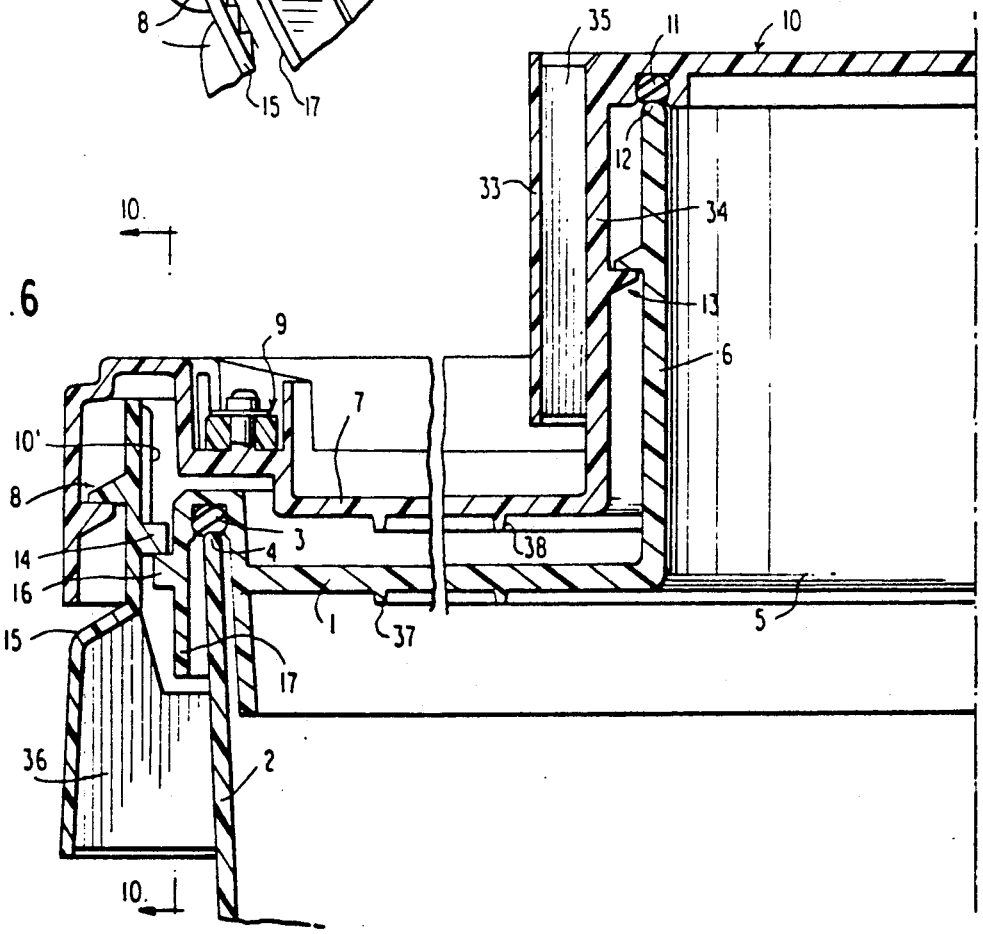
FIG. 6 is a view taken along line 6—6 of FIG. 5 showing the lid screwed onto the outer periphery of the container and the cap portion of the lid screwed onto the spout portion of the container closure portion.

Referring to the drawings and more particularly to FIGS. 1 and 6, the child-resistant molded liquid container lid assembly of the present invention comprises, essentially, a closure 1 fixedly mounted on an open head container 2, the closure 1 including a peripheral sealing ring 3 engaging the top edge 4 of the container 2. A central opening 5 is formed in the closure 1 to provide a pouring spout 6 to facilitate pouring liquid from the container 2. A lid 7 is removably connected to the container closure 1 for closing the pouring spout 6 and includes a circumferentially threaded connection 8 between the container 2 and the lid 7. A locking member 9 is pivotally connected to the lid 7 and is resiliently biased by an integral elliptical spring that cooperates with a gusset wall enclosing the locking members into engagement with locking teeth 10, in the container to thereby releasably hold the lid 7 on the container 2. The central portion of the lid is provided with an integral cap portion 10 for closing the open end of the spout 6, and a sealing ring 11 is carried by the cap portion 10 and engages the top edge 12 of the spout. A threaded connection 13 is provided between the spout 6 and the cap 10 similar to and coordinated with the threaded connection 8 between the lid 7 and the container 2, whereby the lid 7 and cap portion 10 are simultaneously connected to the container 2 and spout 6, respectively, when the lid 7 is secured to the container 2.

As will be seen in FIGS. 2, 3, 6 and 10, the closure 1 is fixedly connected to the container 2 through a bayonet connection provided by a plurality of circumferentially spaced, radially inwardly extending lugs 14 integral with the skirt portion 15 of the container 2 engaging a plurality of circumferentially spaced, radially outwardly extending lugs 16 integral with the skirt portion 17 of the closure 1, the lugs 14 and 16 being inclined, as shown in FIG. 10, to provide a wedging action to secure the closure 1 to the container 2.

In order to facilitate the securing of the closure 1 onto the container 2 and compression of the large peripheral sealing ring 3 to form a liquid tight seal between the closure 1 and the top edge 4 of the container 2, a plurality of recessed abutments 18, FIGS. 3 and 4, are provided in the upper surface of the closure 1 adapted to receive a suitable tool (not shown), whereby after the beginning of thread 13 on spout 6 of closure 1 is aligned to a selected radial position relative to the beginning of thread 8 on container 2, closure 1 can be pushed down relative to the container to compress the sealing ring 3 and rotated relative to the container to engage the bayonet connection lugs 14 and 16, to rigidly connect closure 1 to the container 2. In order to hold the container 2 while securing the closure 1 thereto, a similar but counter recessed abutment 19, FIGS. 7 and 9, is provided in the lower surface of the container bottom wall 20, which is also adapted to receive a tool for holding the container 2 while simultaneously employing the other tool for securing the closure 1 to the container. The beginning of threads 13 and 8 on the pouring spout and container are thereby aligned to selected radial positions relative to each other so they are coordinated to simultaneously connect with the respective corresponding threads 13 and 8 on the cap portion 10 and circumference of lid 7, when the lid is secured to the container.

Another recessed abutment 21, FIGS. 7 and 8, is also formed in the container bottom wall 20, in the direction opposite to that of abutment 19, for receiving a tool to facilitate removing the container 2 from the mold.

While the embodiment of the invention illustrated in FIGS. 2 and 6 shows the bayonet connection between the container 2 and closure 1 being provided by the inwardly and outwardly extending lugs 14 and 16, FIG. 12 discloses another embodiment, wherein the skirt portion 17 of the closure 1 is provided with radially inwardly extending lugs 22 cooperating with radially outwardly extending lugs 23 integral with the side wall of the container 2 below the upper edge 4 thereof, whereby the closure 1 is secured to the container. The lugs 22 and 23 are shaped in the same manner as the lugs 14 and 16, as shown in FIG. 10.

FIG. 13 illustrates yet another embodiment for securing the closure 1 to the container 2, wherein radially inwardly extending lugs 24 are integral with the inner wall surface of the container 2 and cooperate with radially outwardly extending lugs 25 integral with the inner skirt portion 17' of closure 1.

FIG. 14 illustrates still another embodiment, wherein the closure 1 is molded integral with the top edge of the container 2 in lieu of the bayonet connections illustrated in FIGS. 6, 12, and 13. In this embodiment, the container 2 is molded with an open bottom which is then closed by a separate bottom wall 26 having a peripheral channel portion 27 containing a ring seal 28 against which the bottom edge 29 of the container engages. The bottom wall 26 is fixedly connected to the container 2 by a bayonet connection 30, similar to that shown at 24, 25 in FIG. 13.

In lieu of the bayonet connection 30, shown in FIG. 14, the peripheral channel portion 27' of bottom wall 26 can be fixedly connected to the lower edge 29' of the container 2 by providing a plastic weld or adhesive connection, as shown in FIG. 15, as at 31.

To complete the structure of the container and lid assembly, the containers are constructed and arranged to be stacked one-on-top of the other. To this end, as will be seen in FIGS. 2, 3, 7, 14 and 15, the bottom wall of each container 2 is formed with a recess 32 for receiving the cap portion 10 of the lid assembly on the adjacent container.

Figure 5:
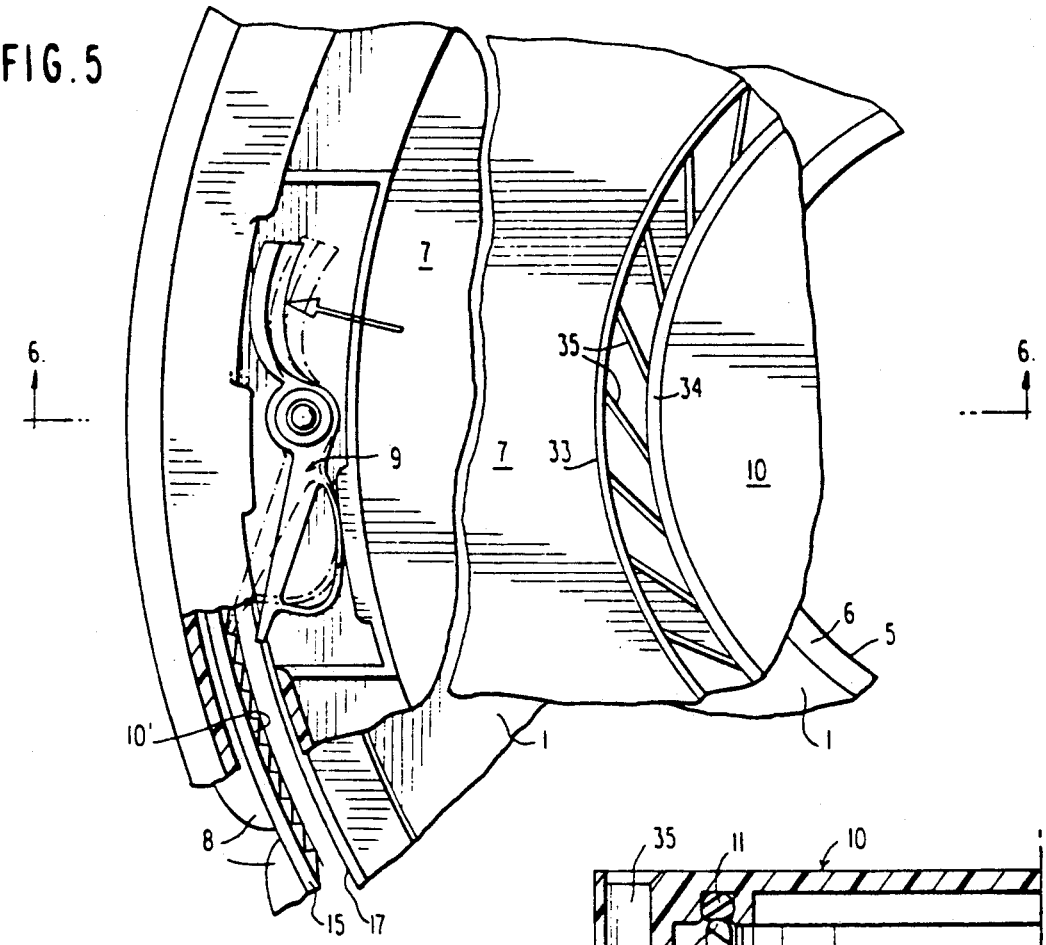
FIG. 5 is an enlarged, fragmentary, top plan view of the container lid showing the resiliently biased locking member moved out of engagement with the locking teeth on the container.

To protect the cap assembly 10 from damage during the transportation and/or stacking of the filled containers, the cap assembly is provided with a shock absorber as best seen in FIGS. 1, 5, and 6, and comprises a cylindrical sleeve 33 spaced outwardly from, and concentrically with respect to an annular wall 34 of the cap assembly. A plurality of inclined, resilient fins 35 are integrally connected between the sleeve 33 and annular wall 34. By this construction and arrangement, the cylindrical sleeve 33 functions as a resiliently supported bumper or shock absorber to absorb any impact forces directed to the cap portion 10.

The container and lid assembly also includes other reinforcing features such as the web portion 36 extending between the skirt portion 15 of the container and the upper outer wall portion of the container 2, as shown in FIGS. 2, 6, 7, 10, 11, and 14; the concentric annular ribs 37 and 38 formed integrally with the bottom surface of the closure 1 and lid 7, respectively, as shown in FIGS. 2, 6; and the concentric annular ribs 39 formed integrally with the upper wall surface of the container bottom wall 26 as shown in FIGS. 14 and 15.

In use, the closure 1 is fixedly connected to the upper end portion of the container, either through the bayonet connection shown in FIGS. 2, 6, 12, and 13, or by being integrally molded thereon with the container. When employing the bayonet type connection, a tool is placed in the abutment recess 19 in the bottom wall 20 of the container, for holding the container 2 from turning, while another tool is placed in the abutment recesses 18 formed in the closure 1, and the closure 1 is pushed down and turned so that the bayonet connection is made as shown in FIG. 10 resulting in the annular seal ring 3 to be squeezed against the top edge of the container to thereby provide a permanent leak proof seal. After the container is filled, the lid 7 is manually threaded onto the top of the container and the closure resulting in the cap portion 10 and associated relatively small diameter seal 11 to be pressed against the top edge of the pouring spout 6 to effectively seal the container's contents therein.

By having the cap portion 10 integral with the lid 7, the force employed to secure the lid 7 onto the container 2 is applied at the outer circumference at the threaded connection 8 which is radially outwardly from the cap portion 10, resulting in an increased torque for applying the integral cap portion 10 to the spout 6 and compressing its smaller diameter seal 11 against the top edge 12 of the spout, than would have been achieved if the cap portion was a separate component merely threaded onto the spout.

When screwing the lid 7 onto the container, the resiliently biased locking member 9 ratchets over the teeth 10'. Any attempt to turn the lid 7 in the opposite direction to remove the lid will be prevented by the locking member 9 engaging the teeth. To release the locking member 9, it is manually pivoted in the direction of the arrow, as shown in FIG. 5, while simultaneously turning the lid 7 to remove it from the container. The operation of the locking member functions in the same manner as disclosed in my afore-mentioned patent and patent application.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A child-resistant molded plastic container lid assembly for an open head container comprising, a closure having an outer peripheral edge, means for fixedly securing said closure to the upper peripheral edge portion of said container, an opening formed in said closure providing a pouring spout having a peripheral edge, a lid, a cap portion integral with said lid for closing said spout, first means for connecting said lid to the upper portion of said container, and second means for connecting said cap portion to said spout, whereby when the lid is connected to said container, the cap portion is simultaneously connected to said spout.

2. The apparatus according to claim 1, wherein the means for fixedly securing the closure to the upper peripheral edge portion of the container comprises, a bayonet connection between the outer peripheral edge of the closure and the upper peripheral edge of the container.

3. The apparatus according to claim 2, wherein the bayonet connection comprises a plurality of circumferentially spaced, radially outwardly extending lugs integral with the outer peripheral edge of the closure, and a plurality of circumferentially spaced, radially inwardly extending lugs integral with the upper peripheral portion of the container, said inwardly and outwardly extending lugs being inclined to the horizontal and wedged into engagement, to thereby fixedly secure the closure to the container.

4. The apparatus according to claim 2, wherein the bayonet connection comprises a plurality of circumferentially spaced, radially inwardly extending lugs integral with the outer peripheral edge portion of the closure, and a plurality of circumferentially spaced, radially outwardly extending lugs integral with the outer wall surface of the container, said inwardly and outwardly extending lugs being inclined to the horizontal and wedged into engagement, to thereby fixedly secure the closure to the container.

5. The apparatus according to claim 2, wherein the bayonet connection comprises, a plurality of circumferentially spaced, radially inwardly extending lugs integral with the inner wall surface of the container, and a plurality of circumferentially spaced, radially outwardly extending lugs integral with the closure, said inwardly and outwardly extending lugs being inclined to the horizontal and wedged into engagement, to thereby fixedly secure the closure to the container.

6. The apparatus according to claim 1, wherein the closure is molded integral with the top peripheral edge of the container.

7. The apparatus according to claim 1, wherein the first means for connecting the lid to the upper portion of the container comprises a threaded connection between the lid and the container.

8. The apparatus according to claim 7, wherein the second means for connecting the cap portion to said spout comprises a threaded connection between the cap portion and the spout, whereby the force employed to secure the lid onto the container is applied at a point on the lid radially outwardly from the cap portion resulting in an increased torque for applying the integral cap portion to the closure spout, to thereby effectively seal the contents within the container.

9. The apparatus according to claim 1, wherein an annular sealing ring is mounted between the outer peripheral edge of the closure and the upper peripheral edge of the container.

10. The apparatus according to claim 1, wherein an annular sealing ring is mounted between the cap portion and the peripheral edge of the spout.

11. The apparatus according to claim 6, wherein the container is molded with an open bottom end, a separate bottom wall, and means for connecting the separate bottom wall to the open end of the container.

12. The apparatus according to claim 11, wherein the means for connecting the bottom wall to the container comprises a bayonet connection between the bottom wall and the bottom wall portion of the container.

13. The apparatus according to claim 12, wherein the bottom wall is formed with an outer peripheral edge portion having a channel formed therein, an annular sealing ring mounted within the channel, the open bottom end of the container having a peripheral edge inserted into said channel and sealingly engaging said sealing ring.

14. The apparatus according to claim 11, wherein the means for connecting the separate bottom wall to the open end of the container comprises a plastic weld between the container and the bottom wall.

15. The apparatus according to claim 1, wherein the bottom wall of the container is formed with a recess dimensioned to receive a cap portion, whereby the closed containers can be stacked.

16. The apparatus according to claim 1, wherein a shock absorber is connected to the cap portion to prevent damage to the cap portion during shipment.

17. The apparatus according to claim 16, wherein the shock absorber comprises an annular wall connected to the cap portion, a cylindrical sleeve spaced outwardly from and concentrically with respect to said annular wall, and a plurality of resilient fins integrally connected between the sleeve and annular wall, whereby the sleeve functions as a resiliently supported bumper for absorbing impact forces directed to the cap portion.

18. The apparatus according to claim 2, wherein a recess abutment is provided in the upper surface of the closure, and another recessed abutment is provided in the lower surface of the container bottom wall, whereby a tool can be inserted into the closure abutment for connecting the closure to the container, while another tool is inserted into the recessed abutment in the container bottom wall for holding the container while securing the closure thereto.

19. The apparatus according to claim 1, wherein the container is formed with a skirt portion positioned radially outwardly from the upper wall portion of the container, a web portion extending between the skirt portion and the upper wall portion, and concentric annular ribs formed integrally with the face surfaces of the closure, lid and bottom wall of the container, to thereby reinforce the container and associated lid assembly.

20. The apparatus according to claim 1, wherein a resiliently biased locking member is pivotally connected to the peripheral edge of the lid, and locking teeth provided on the peripheral edge of the container, whereby the locking member engages the teeth to thereby prevent the unauthorized removal of the lid from the container and spout.

* * * * *